US007975331B2

(12) United States Patent
Flocard et al.

(10) Patent No.: US 7,975,331 B2
(45) Date of Patent: Jul. 12, 2011

(54) DEVICE AND METHOD FOR CONTROLLING HUMIDITY AT THE SURFACE OF A SUPPORTING ITEM OF THE MATTRESS TYPE

(75) Inventors: Thierry Flocard, Montpellier (FR); Gilles Camus, Montpellier (FR)

(73) Assignee: Hill-Rom Industries SA, Montpellier (FR)

( * ) Notice: Subject to any disclaimer, the term of this patent is extended or adjusted under 35 U.S.C. 154(b) by 147 days.

(21) Appl. No.: 11/876,836

(22) Filed: Oct. 23, 2007

(65) Prior Publication Data

US 2008/0098529 A1 May 1, 2008

(30) Foreign Application Priority Data

Oct. 26, 2006 (FR) ..... 06 54548

(51) Int. Cl.
*A47C 27/00* (2006.01)
*A47G 9/00* (2006.01)
*A47C 17/00* (2006.01)

(52) U.S. Cl. ..... 5/423; 5/484; 5/737; 5/724

(58) Field of Classification Search ..... 5/423, 724, 5/726, 952, 939, 699, 484, 737
See application file for complete search history.

(56) References Cited

U.S. PATENT DOCUMENTS 4,638,519 A 1/1987 Hess
4,729,598 A 3/1988 Hess
4,797,962 A 1/1989 Goode
4,888,958 A 12/1989 Ella
4,896,389 A 1/1990 Chamberland
4,914,771 A 4/1990 Afeyan
4,944,060 A 7/1990 Peery et al.
4,949,412 A 8/1990 Goode
4,949,413 A 8/1990 Goodwin
4,949,414 A 8/1990 Thomas et al.
5,003,654 A 4/1991 Vrzalik
5,005,240 A 4/1991 Vrzalik
5,022,110 A 6/1991 Stroh
5,035,014 A 7/1991 Blanchard
5,035,016 A 7/1991 Mori et al.
5,044,029 A 9/1991 Vrzalik
5,052,067 A 10/1991 Thomas et al.
5,062,167 A 11/1991 Thomas et al.
5,065,466 A 11/1991 Thomas et al.
5,073,999 A 12/1991 Thomas et al.
5,090,077 A 2/1992 Caden et al.

(Continued)

*Primary Examiner* — Jonathan J Liu
(74) *Attorney, Agent, or Firm* — Barnes & Thornburg LLP

(57) ABSTRACT

The present disclosure concerns a device for controlling humidity at the surface of a supporting item (3) of the mattress or cushion type and in the vicinity of the body (13) of an individual resting thereon, comprising an envelope (1) formed by at least two parts ($\mathbf{1}_1$, $\mathbf{1}_2$) connected with each other at their peripheral edges (1*a*, 1*b*), such as being sealed by welding (1*c*), defining an inner chamber ($\mathbf{1}_3$), the two parts having a first part ($\mathbf{1}_1$) intended to be positioned on the side of said body of the individual, and a second part ($\mathbf{1}_2$) intended to be positioned on the side of said supporting item (3) of the mattress or cushion type, the first part including a material forming a barrier impervious to air and liquid water and pervious to water vapor, the second part including a material pervious to water vapor, the second part comprising at least one air injection port (4) and means for discharging air comprising perforated or porous areas pervious to air, such as perforations (5).

22 Claims, 2 Drawing Sheets

U.S. PATENT DOCUMENTS 5,095,568 A 3/1992 Thomas et al.
5,121,513 A 6/1992 Thomas et al.
5,152,021 A 10/1992 Vrzalik
5,249,318 A 10/1993 Loadsman
5,251,347 A 10/1993 Hopper et al.
5,267,364 A 12/1993 Volk
5,269,030 A 12/1993 Pahno et al.
5,272,778 A 12/1993 Gore
5,301,457 A 4/1994 Seely
5,305,483 A 4/1994 Watkins
5,438,721 A 8/1995 Pahno et al.
5,483,709 A 1/1996 Foster et al.
5,493,742 A 2/1996 Klearman
5,509,155 A 4/1996 Zigarac et al.
5,513,406 A 5/1996 Foster et al.
5,560,057 A 10/1996 Madsen et al.
5,586,346 A 12/1996 Stacy et al.
5,603,133 A 2/1997 Vrzalik
5,606,754 A 3/1997 Hand et al.
5,699,570 A 12/1997 Wilkinson et al.
5,704,084 A 1/1998 Evans et al.
5,729,853 A 3/1998 Thompson
5,749,109 A * 5/1998 Kappel ..... 5/423
5,755,000 A 5/1998 Thompson
5,787,534 A 8/1998 Hargest et al.
5,794,288 A 8/1998 Soltani et al.
5,815,864 A 10/1998 Sloop
5,882,349 A 3/1999 Wilkerson et al.
5,890,245 A 4/1999 Klearman et al.
5,926,884 A 7/1999 Biggie et al.
5,970,550 A 10/1999 Gazes
5,983,429 A 11/1999 Stacy et al.
6,012,186 A 1/2000 Soltani et al.
6,062,215 A 5/2000 Leininger et al.
6,073,291 A 6/2000 Davis
6,115,860 A 9/2000 Vrzalik
6,148,461 A 11/2000 Cook et al.
6,212,718 B1 4/2001 Stolpmann et al.
6,282,737 B1 9/2001 Vrzalik
6,317,912 B1 11/2001 Graebe et al.
6,421,859 B1 7/2002 Hicks et al.
6,487,739 B1 12/2002 Harker
6,499,166 B1 12/2002 Jones
6,536,056 B1 3/2003 Vrzalik et al.
6,546,576 B1 * 4/2003 Lin ..... 5/423
6,687,937 B2 2/2004 Harker
6,694,557 B1 2/2004 Bobey et al.
6,698,046 B1 3/2004 Wu
6,708,352 B2 3/2004 Salvatini et al.
6,730,115 B1 5/2004 Heaton
6,745,996 B1 6/2004 Guthrie
6,782,574 B2 8/2004 Totton et al.
6,820,640 B2 11/2004 Hand et al.
6,855,158 B2 2/2005 Stolpmann
6,892,405 B1 5/2005 Dimitriu et al.
6,910,235 B2 * 6/2005 Lack et al. ..... 5/413 AM
6,942,687 B1 9/2005 Heaton et al.
7,036,171 B2 5/2006 Wu
7,152,264 B2 12/2006 Boyd
7,171,711 B2 2/2007 Gowda
7,296,315 B2 11/2007 Totton et al.
2002/0073489 A1 6/2002 Totton et al.
2002/0138910 A1 10/2002 Boyd
2002/0195144 A1 12/2002 Hand et al.
2003/0046762 A1 3/2003 Stolpmann
2003/0084511 A1 5/2003 Salvatini et al.
2004/0031103 A1 2/2004 Wyatt et al.
2004/0177450 A1 9/2004 Salvatini et al.
2004/0256588 A1 12/2004 Guthrie
2005/0022308 A1 2/2005 Totton et al.
2005/0091752 A1 5/2005 Gowda
2006/0080778 A1 * 4/2006 Chambers ..... 5/652.2
2006/0156473 A1 7/2006 Chambers et al.
2006/0272097 A1 12/2006 Dionne et al.
2007/0101506 A1 5/2007 Pirzada
2007/0234482 A1 10/2007 Wright
2007/0261548 A1 11/2007 Vrzalik et al.

* cited by examiner

DEVICE AND METHOD FOR CONTROLLING HUMIDITY AT THE SURFACE OF A SUPPORTING ITEM OF THE MATTRESS TYPE

The present application claims priority, under 35 U.S.C. §119(a), of French National Application No. 06 54548 which was filed Oct. 26, 2006 and which is hereby incorporated by reference herein.

BACKGROUND

The present disclosure concerns devices and methods for controlling humidity at the surface of a supporting item of the mattress or cushion type and in the vicinity of the body of an individual resting thereon.

This humidity may originate from the body of the patient by the flow of a body liquid such as by sweating, or from an external source of spread liquid. Indeed, it is desirable to avoid maceration of liquid at soft tissues of the skin, whether this is an external liquid or sweat, because this humidification causes maceration which promotes formation of eschars and maintains foci of infection.

Methods and devices of this type are known, which consist of injecting air at the surface or towards the body of the individual, by applying said air loss mattresses or cushions (<<low-air-loss beds>>) consisting of compartments inflated with pressurized air. Thus, the body of the individual or the area between the body and the supporting item, i.e. the mattress at which humidity may be generated, is dried by the air flow oriented in this direction.

A first problem of this known device is that it cannot be applied independently of the supporting item, notably of the mattress and that interruption of the air injection inside the mattress results in it being made inoperative. Another drawback of this said air loss mattress system is that it may lead to excessive desiccation of the body and requires compensation of hydric losses by a program for hydrating the individual.

Dehumidification systems in the vicinity of a patient have been described which consist of a cover comprising an envelope inserted between the patient and the mattress, said envelope comprising an upper layer and a lower layer delimiting a chamber in which air is caused to flow. In these systems, it is sought to dehumidify the external surface of said upper layer on which said patient rests, at least in part with transfer of water vapor by molecular migration of water molecules through the upper layer of the envelope pervious to water vapor.

In U.S. Pat. No. 5,882,349, the lower layer of the envelope is impervious to air and to water vapor, and if necessary the air is injected into only a portion of the internal volume of said envelope through a plurality of injection ports, and is discharged by a plurality of perforations which may be positioned on the sides of the upper layer. This dehumidification system is comparatively not very performing with an announced dehumidification of only 400 ml/24 h.

In U.S. Pat. No. 5,926,884, a mattress coverlet of this type is described, wherein air is exclusively discharged through perforations in the upper layer over the whole surface and notably at the area covered by the patient, and the lower layer is pervious to water vapor. The thereby formed envelope between the lower layer and the upper layer, both pervious to water vapor, is completed with an additional underlying layer absorbing and dispersing water vapor which risks building up between the thereby formed dehumidification device and the mattress.

In these dehumidification devices by transfer of water vapor, partial discharge of air on at least the side of the patient resting on the device has risks of contaminating the envelope by penetration of liquid or another contaminant coming from the external surface of the upper layer on which the patient rests. On the other hand, and above all, the yields in terms of dehumidification, are either relatively small or they are accompanied by dehydration of the patient resulting from the excessive air flow sent in proximity to the patient.

SUMMARY

The present disclosure discloses a method and device for controlling humidity at the surface or in the vicinity of the body of an individual resting on a supporting item of the mattress or cushion type which, optionally, may not have one or more of the above drawbacks and may be more performing in terms of dehumidification yield.

More particularly, the present disclosure discloses a device and method which may be applied independently of said supporting item and notably on any type of air or foam mattress, or other mattress, which may have suitable features to maintain sanitary conditions with regard to risks of contamination of a fluid from the outside, and which may not require application of concomitant hydration of the patient.

Another optional aspect of the present disclosure is a device which allows automated humidity control and not simply a device only providing a continuous reduction of humidity, like air loss mattress devices from the prior art.

In order to accomplish this optional feature, the present disclosure discloses a device for controlling humidity at the surface of a supporting item of the mattress or cushion type and in the vicinity of the body of an individual resting thereon, comprising an envelope formed by at least two parts connected with each other at their peripheral edges, preferably sealed by welding, defining an inner chamber, said two parts consisting in a first part intended to be positioned on the side of said body of the individual, and a second part intended to be positioned on the side of said supporting item of the mattress or cushion type, said first part consisting of a material forming a barrier impervious to air and liquid water and pervious to water vapor, said second part consisting of a material pervious to water vapor, said second part comprising at least one air injection port and air discharging means comprising perforated or porous areas pervious to air, such as perforations.

It is contemplated that said first part may be non-perforated and that air may be exclusively discharged through said second part inserted between said first part and said supporting item of the mattress or cushion type.

In the case of a mattress positioned horizontally on a bed, said first part may be an upper part on which the body of the individual rests and said second part may be a lower part applied on the mattress and positioned below said first part or upper part.

In some instances, said discharging means, such as perforations, may be positioned relatively to said injection port(s) so as to be able to generate an incoming air flow in said chamber through said injection port and discharge it from said chamber through said discharging means, such as perforations, in all the volume of said chamber when said envelope is inflated with continuously injected pressurized air through said injection port so as to generate overpressure in said chamber.

The present disclosure also discloses a method for controlling the humidity at the surface of a supporting item of the mattress or cushion type and in the vicinity of the body of an individual resting thereon, by means of the devices contemplated by this disclosure, characterized in that the following steps may be performed wherein:

1) said envelope is positioned flat between said supporting item and said body of an individual, so that said first part is turned towards the side of the body of the individual and said second part is turned towards the side of said supporting item, and 2) pressurized air is injected into said chamber through said injection port at a pressure and at a flow rate such that said envelope remains inflated, overpressurized in spite of the discharge of the air by said discharging means and of the pressing of the body on said envelope.

It is contemplated that air may be injected at a pressure and at a flow rate such that the air inside the chamber is overpressurized relatively to the air outside the chamber.

Owing to the water vapor perviousness properties of said first part, a transfer of water vapor may be performed through said first part when a relative humidity gradient exists between the outer surface of said first part of the envelope and the inside of said chamber, notably in the case of maceration of a liquid or sweating of the body or in proximity to the body between the body and said envelope, which is accompanied by dehumidification of the surface of said first part. When the humidity content is identical on both sides of said first part, i.e. between the outside and the inside of said envelope, there is no longer any relative humidity gradient and the transfer of water vapor is interrupted automatically. But, the flow of air inside the envelope allows the water vapor to be carried off, to be discharged outwards through said second part. This flow therefore promotes a reduction in the humidity content inside the envelope and, if need be, maintains the transfer of water vapor from the outside of the envelope towards the inside of the envelope as long as the humidity outside the latter is larger than the relative humidity of the air inside the envelope and therefore than the humidity of the injected ambient air. Because the humidity outside the envelope at the surface of the envelope is reduced until it reaches the relative humidity level of the injected ambient air; and the transfer of water vapor is interrupted automatically at this moment, excessive dehydration of the tissues of the skin of said body may thereby be avoided.

Further, because of the water vapor perviousness properties of said second part, the water vapor transferred inside said chamber may be discharged outwards in spite of the air flow, by which the establishment of a high relative humidity gradient may be maintained and promoted between the outside of said first part and the inside of said chamber.

In some embodiments, because said second part is pervious to water vapor and air is exclusively discharged through said second part, a dehumidification method may be provided exclusively by transfer of water vapor by molecular migration through the device and this with a higher rate of water vapor transfer and therefore of dehumidification than in the prior art, without the risk of excessive humidification below the device between said second part and the mattress, without risk of contamination by penetration of contaminant or liquid from the upper outer surface of said first part since the latter is non-perforated, and finally without requiring any concomitant hydration treatment of the patient as this is the case when the air is discharged from the upper layer towards the patient or in proximity thereto.

A device embodiment according to the disclosure has higher dehumidification performances than in the U.S. Pat. No. 5,882,349. In particular, the inventors have discovered that if the lower layer is impervious to water vapor, as in U.S. Pat. No. '349, humidity saturation of the inside of the envelope is established rapidly. According to this disclosure, because said second part or lower layer is pervious to water vapor and the injected air flows in the whole volume of the chamber, the water vapor transfer yield from the outer surface of said first part on which the patient rests, towards the outer surface of said second part on the mattress side, is much higher.

Moreover, because, according to the present disclosure, the air is discharged through said second part or lower layer, the transferred water vapor in the subface of said second part or lower layer does not build up between the latter and the mattress on which it is deposited, and is evaporated by the discharged air which is thereby injected therein.

In an embodiment disclosed herein, the water vapor perviousness of said second part is less than that of said first part.

With this limited perviousness to water vapor of said second part, build-up of humidity may be avoided between said second part and said supporting item and this humidity may be evaporated by the sole flow of air from said air discharging means in the absence of injection of additional air between said second part and said supporting item.

The low performance of the system described in U.S. Pat. No. '349 is thus explained by the fact that the air is not injected so as to overpressurize the total volume of the chamber, which limits the active surface for transferring water vapor. Indeed, in the absence of overpressure, a uniform distribution in the volume portion of the relevant chamber and/or, if need be, a uniform or homogeneous flow are not obtained in the entire volume of the chamber. On the contrary, according to some embodiments of the present disclosure, by establishing an overpressure, it is possible to obtain a maximum transfer of water vapor through the upper and lower layers.

In some instances, said second part is substantially airtight between said injection port and said perforated or porous areas pervious to air, the latter being positioned sufficiently far from said injection port so that substantially the whole volume of said chamber is covered by the air flowing between said injection port and said perforated or porous areas.

In some instances, according to the embodiments contemplated in this disclosure, the ratio between the cumulative sections of the discharged perforations and the section of the injection ports may be selected so as to obtain a compromise between the search for a high flow rate of air flowing through the chamber on the one hand and sufficient overpressure inside the chamber on the other hand. In such embodiments, the overpressure may be sufficient in order to guarantee that the injected air flows into the whole volume of the chamber, i.e. the air is uniformly distributed in the whole volume of the chamber. Otherwise there may be a risk of the injected air being restricted to flow inside said chamber only between said injection port(s) and those of said perforated or porous localized areas which correspond to the passage with minimum pressure loss.

However, it is contemplated that the overpressure could be limited so as not to destabilize the body of the individual resting against said envelope.

In practice, with an overpressure of at least 500 Pa, it is possible to obtain a homogeneous air flow in all directions and notably in the area below or facing the body of the patient.

Moreover, the upper limit of the flow rate of air flowing in the chamber is related to the maximum void rate, i.e. to the cumulative section of the ports, that the material of said second part may tolerate from a point of view of its mechanical strength. This rate should optionally not generally exceed 10%. Further, the fact that the positive effect of the increase of the air flow rate on the dehumidification performance is limited by the water vapor transfer capacity of said first and second layer parts, should be taken into account. Beyond a certain air flow rate, the dehumidification performances may no longer be improved.

In some embodiments, a flow rate of 20 to 50 l/min provides sufficient dehumidification performances taking into account the migration time of the water molecules for transferring water vapor through the applied polymer layers as described hereafter.

More particularly, in order to obtain an overpressure from 500 to 1,000 Pa with an air flow rate of 20 to 50 l/min, the ratio of the sum of the sections of the perforations or pores of said perforated or respectively porous areas for discharging air over the sum of the sections of the injection ports is at least 2, optionally from 2 to 4, in some embodiments contemplated herein.

Evaporation of the surface water on the side of the patient may be accompanied by a slight reduction in the temperature which promotes reduced sweating if need be and may compensate the increase in temperature resulting from the compression of the injected air.

More particularly with regard to some embodiments, the water vapor transfer of said first part may be at least 750, preferably from 750 to 2,000 g of water/$m^2$/24 hrs, still preferably about 1,000 g/$m^2$/24 hrs and the water vapor transfer of the second part is less than 500 g of water/$m^2$/24 hrs, preferably from 300 to 500 g of water/$m^2$/24 hrs.

In some embodiments, the device according to the invention comprises an intermediate part inside said chamber between said first and second parts, said intermediate part being pervious to air and to water vapor.

This intermediate layer promotes the spacing apart of said first and second parts and thereby facilitates the air flow inside the chamber and so its better diffusion and then a better discharge of the water vapor. This intermediate part included inside the chamber therefore may have the effect of avoiding climatic bridges between said first and second parts and of providing a better passage for air.

In some embodiments, said intermediate part may consist of a layer of a non-woven fiber material, such as polyester wadding, that may be held in shape by a holding device, such as a net and/or a checkerwork of seams of the quilt type.

The intermediate layer thus may have an absorbing effect promoting better distribution and spread of humidity and therefore better diffusion of humidity inside said chamber, the humidity thus may be more rapidly discharged by the air injected inside said chamber and inducing more performing dehumidification.

In some embodiments, said first part may comprise a non-watertight and non-airtight porous or perforated substrate, said substrate optionally being coated on at least one face with a continuous layer of polymer impervious to liquid water and air, having water vapor molecular transfer properties.

Still more particularly, said second part may comprise a fabric optionally coated on at least one of its faces with a layer of polymer of the polyurethane type, such as on the outer face on the side of said physical body.

A perforated substrate such as a fabric resulting from the weaving of fibers or yarns has porosities or perforations which may not form a barrier to the passage of water vapor transferred through the layer of polymer of the polyurethane type.

Polymers and textile materials of this water vapor transfer type are known to one skilled in the art and available commercially and are notably used in the clothing industry for their body breathing property and elimination/control of sweating.

This water vapor molecular transfer property of said polymers results from the molecular affinity inducing attraction of water molecules on the molecular chains of the polymer, notably of polyurethane, comprising hydrophilic groups, said water molecules may thus make their way along the polymer chain and cross the layer of said polymer.

In some embodiments, said second part may comprise a fabric coated on at least one of its faces with a polymer layer pervious to water vapor, i.e. having water vapor molecular transfer properties, preferably on the face turned towards the inside of said chamber.

In some embodiments, said first and second parts may be connected together on their peripheral edges by welding, directly with each other or via a connecting strip coated with a polymer layer, the different polymer layers of said first and second parts and of said strip, if appropriate, being weldable with each other by thermo-welding or welding by irradiation, such as by high frequency irradiation.

More particularly, the different polymer layers may be of the same chemical nature or of a chemical nature capable of making them weldable with each other, which is the case of polymers of the polyurethane type.

Both of said parts may be coated with polymer on both of their faces, and be sealed directly with each other. Both parts may, for economical reasons, be coated with polymer only on one face. And, if at least one of the internal faces of both parts is not coated with polymer, notably if the first part is coated with polymer on its external face, and the second part of its internal face, the edge of one of the two parts may be folded over itself so as to have its face coated with polymer turned towards the inside of said chamber.

In an embodiment, it is also possible to apply a peripheral connecting strip possibly folded over itself, providing the welding connection between both of said first and second parts, said strip being itself coated on at least one face with a polymer layer which is weldable with the polymer layers of both of said first and second parts, the polymer layer of said strip being of the same nature, impervious to liquid water, air and water vapor, as that of said second part.

In some embodiments, said constitutive sheets of said first and second parts are extensible sheets in both longitudinal and transverse directions. More particularly, with this property it is possible to promote better distribution of the weight of the body, i.e. over its larger surface, and further that the sheet conforms with the shape of the body and does not generate localized points of excessive compression of the body which may generate blocking of vascularization and pathologies which result from this.

In some embodiments, said air discharge perforations are positioned on the periphery of said second part. These peripheral areas do not coincide with the central area of the envelope on which the body is normally supported, but surround the later, thereby facilitating discharge of air through said perforations.

In some embodiments, said second part is of a substantially rectangular shape and the device comprises a single said injection port in proximity to the middle of a longitudinal edge of said second part, said air discharge perforations being positioned in proximity to the side edges and to the longitudinal edge opposite to that of the said injection port.

Thus, the injection port may be positioned relatively to said discharge perforations so as to cause the air to properly flow everywhere within the internal chamber of the envelope and to discharge the humidity transferred from the vicinity or the surface of the body towards the inside of said chamber, outwards as rapidly as possible.

In a method according to the disclosure, an overpressure of air may be established inside said chamber relatively to the outside of the chamber, sufficient to have the air flow in the whole volume of said chamber, and more particularly an overpressure of 500 to 1,000 Pa, such as about 750 Pa, is established with an air flow rate in said chamber of at least 20 l/min, such as from 30 to 50 l/min.

According to this disclosure, the device my further comprise a device for injecting compressed air feeding said envelope with air through a said injection port.

It is also contemplated that, in a method according to this disclosure, air may be further injected between said second part and said supporting item, such as from the same device for injecting compressed air feeding said envelope through said injection port.

In some embodiments, said supporting item may comprise at least one inflatable compartment, filled with air, and may be connected to the same air injection device as the one feeding said envelope.

The air filling said chamber may thereby be derived from the same source of air as the one with which the mattress may be inflated via a device orienting the air selectively, for example a solenoid valve acting as a diverter device for a single source of air. Said solenoid valve may be an integral part of a module cooperating with the device according to the invention.

Air injection facilities in an inflatable mattress have notably been described in the patents of the applicant, EP 676 158, FR 2 751 743, FR 2 757 377, FR 2 757 378, FR 2 758 259, FR 2 760 967.

In some embodiments, the device according to this disclosure may further comprise a remote control system such as for remotely controlling said device for injecting compressed air.

In some embodiments, the device according to this disclosure is integrated into a protective cover of a so-called supporting item of the mattress or cushion type, at least at the portion of the cover intended to cover the portion of the face of the supporting item on which at least one portion of the body of an individual is intended to rest.

In some embodiments, the device according to this disclosure may further comprise a device for heating and/or cooling the injected air and/or the air inside said chamber. Thus, it is possible to control the temperature at the outer surface of said envelope and therefore in the vicinity of the body of the individual.

BRIEF DESCRIPTION OF THE DRAWINGS

Other features of the present invention will become apparent in the light of the detailed description which follows and in FIGS. 1-3 wherein.

DETAILED DESCRIPTION

Figure 1:
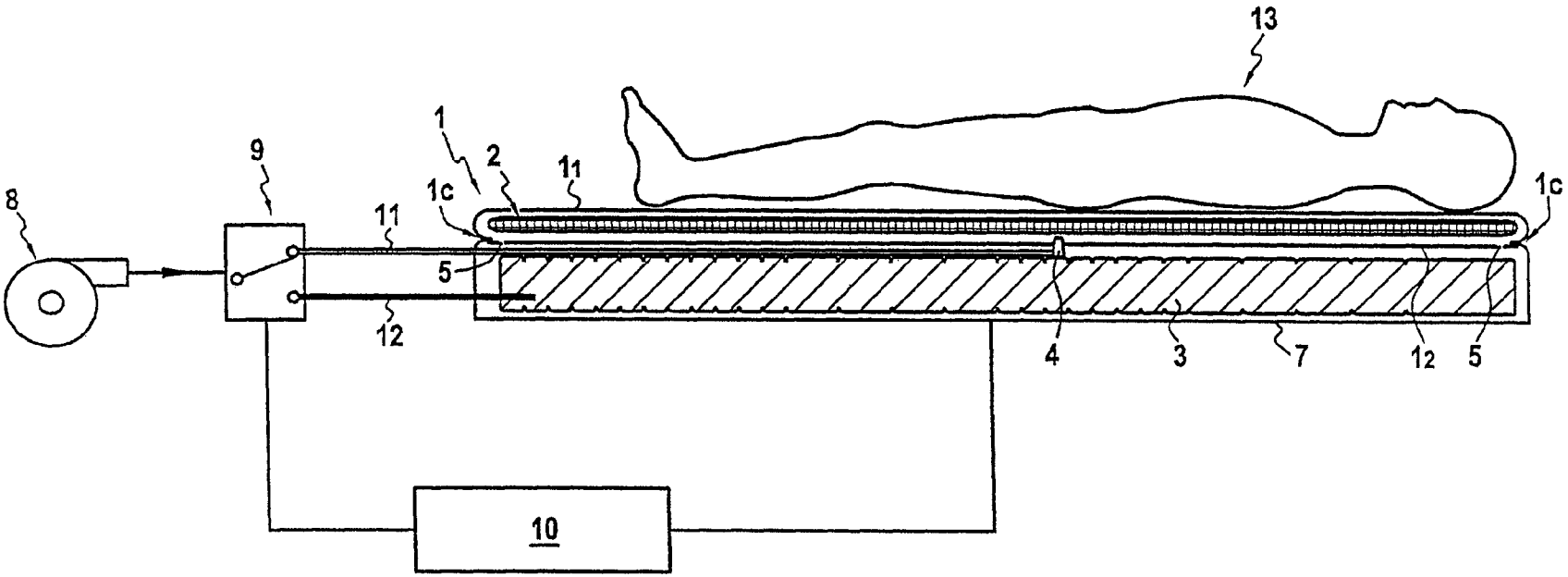
FIG. 1 illustrates a schematic longitudinal sectional view of a mattress inflated with air covered with a protective cover incorporating the control device according to this disclosure, and on which a patient rests.
Figure 2:
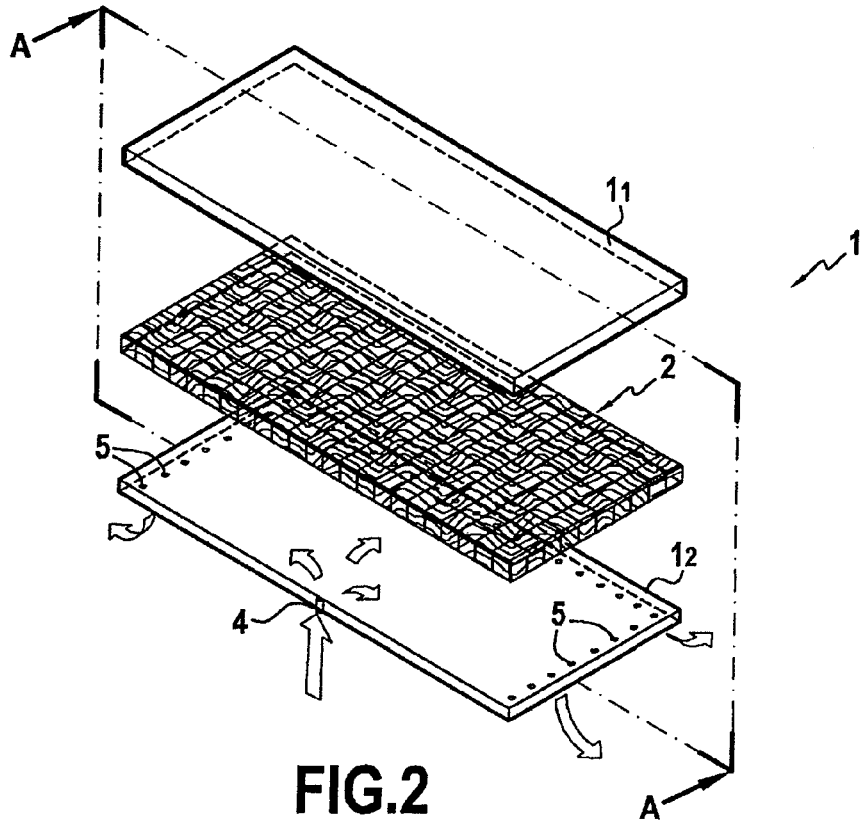
FIG. 2 illustrates a schematic view of the 3 upper, intermediate and lower parts respectively which compose a control device according to this disclosure.
Figure 3:
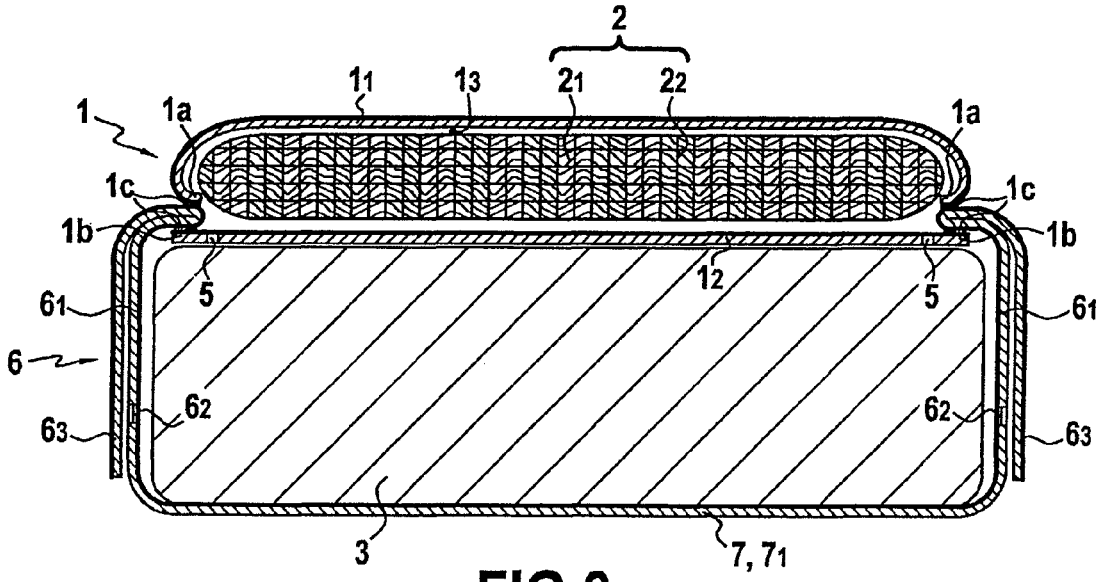
FIG. 3 schematically illustrates, in a cross-sectional view, a method for welding the lower part on the upper part via a band 6 forming a side rim $\mathbf{6}_1$ of a cover ending with a closing/opening zipper device $\mathbf{6}_2$ and also forming a protective flap $\mathbf{6}_3$ of a closing/opening device $\mathbf{6}_2$.

In FIGS. 1-3, a control device according to this disclosure is illustrated, comprising an envelope 1 formed from 2 parts: an upper part or said first part $\mathbf{1}_1$ and a lower part or said second part $\mathbf{1}_2$, the peripheral edges 1*a* and 1*b* of which are welded 1*c* together via a connecting strip 6 folded over itself, the welding lines 1*c* substantially following a rectangular contour.

The envelope 1 of the control device according to the present disclosure is integrated to a protective cover 7 covering an air mattress 3. More particularly, the envelope 1 forms the other face of the protective cover, and a portion of the connecting strip 6 forms side rims $\mathbf{6}_1$ of the protective cover partly covering the flanks of the mattress 3, said second lower part or said second part $\mathbf{1}_2$ being directly applied on the mattress 3.

Said upper and lower parts are therefore of a substantially rectangular shape substantially corresponding to the dimensions of the mattress. The cover includes a peripheral closing/opening zipper device with teeth $\mathbf{6}_2$ along the sides or side rims of the cover covering the section of the mattress, said closing/opening device $\mathbf{6}_2$ allowing separation of a lower cover portion $\mathbf{7}_1$ and the side rims $\mathbf{6}_1$ and withdrawal of the mattress from the cover.

The upper part or first part $\mathbf{1}_1$ consists of a fabric of polyester yarns coated on its outer upper face with a polymer of the polyurethane type having water vapor transfer properties.

More specifically, these polymers of the polyurethane type consist of molecular chains of polyurethane containing hydrophilic ester groups allowing transfer of water vapor by molecular migration of water molecules by means of physicochemical interaction with said hydrophilic ester groups of said molecular chains.

Such sheets coated on one face with polyurethane having water vapor transfer properties are marketed under the brand Dartex®, notably under reference P510, having water vapor transfer properties of about 1,000 g of water/$m^2$/24 hrs (the amount of water which may be transferred through the coated sheet), and comprising a composition of 66% polyester and 34% polyurethane and a basis weight of 130 g/$m^2$.

The lower part or second part $\mathbf{1}_2$ consists of nylon fabric based on polyamide coated on one face with a polyurethane layer pervious to water vapor, marketed by the Dartex® company, notably under reference P280 with a water vapor transfer rate of about 350 g of water/$m^2$/24 hrs, a composition of 47% polyamide and 53% polyurethane and a basis weight of 179 g/$m^2$.

The envelope formed by both lower and upper parts delimits an internal chamber $\mathbf{1}_3$. Inside the chamber, an intermediate part 2 is inserted, which occupies substantially the whole volume of the chamber with a substantially rectangular shape, consisting of a layer of non-woven material $\mathbf{2}_1$ with a thickness from 5 to 10 mm, based on 160 g/$m^2$ polyester wadding, forming an absorbing material pervious to air and to water. This intermediate layer has the dual property of distributing and diffusing in a homogenized way the water vapor transferred inside the chamber from the outer surface of the upper part, and of forming a spacer between the lower and upper parts to avoid contact between both parts.

The intermediate layer of the non-woven material is covered with a synthetic net $\mathbf{2}_1$ of the polyester fiber tulle type. A peripheral seam makes the layer of the intermediate part, integral with said net; for example, longitudinal and side checkerwork seams provide stabilization of the shape of the intermediate part.

In an embodiment, air is injected so as to generate an overpressure of about 750 Pa in the envelope 1 relatively to the outside air by establishing a balanced rate of incoming air flow and exiting air flow from 25 to 35 l/minute. To do this, the lower part $\mathbf{1}_2$ comprises an air injection port (or orifice) 4 at the centre, of about 9.5 mm and in proximity to a longitudinal edge of the lower part $1_2$, said air injection port consisting of a welded plastic connector. Air discharge perforations with a diameter of about 3 mm are regularly spaced apart by 10-20 cm along the 3 other edges of the lower part $1_2$, i.e. both transverse edges and the longitudinal edge opposite to that of the injection port. For a bed of about 2 m long over 90 cm wide, 48 perforations were thereby made. The cumulative sections of the discharge perforations 5 thus represent about twice the section of the injection port 4. Thus, pressure losses related to restrictions in the air passage are compensated and equilibrium is maintained between the incoming and exiting air flow rate with this flow rate of 25-35 l/minute and this overpressure of about 750 Pa of the air inside the chamber relatively to the outside.

The air injection port (or orifice) 4 is fed by a compressor 8 which also allows the air mattress 3 to be fed via a solenoid valve 9 which is used as a diverter controlled by a servo-control device 10, either for feeding the mattress with air 12 or for feeding the air injection port with air 11 inside said chamber, notably depending on measurements of a mattress inflation pressure sensor.

With the control device according to this disclosure it is thus possible to dry up 500 ml of uniformly spread water over a cotton sheet with the dimensions of the mattress, i.e. about 2 $m^2$ within 3 hrs 30 min when said mattress is covered with a dummy simulating the body of a patient in the presence of said intermediate part 2 and for 6 hrs in the absence of said intermediate part, the tests having been conducted in an ambient atmosphere with about 40% relative humidity and at a room temperature of about 25° C.

In FIG. 1, the weld connection of the lower part $1_2$ and upper part $1_1$ is achieved via connecting strips 6. More specifically, a connecting strip 6 consisting of a fabric coated on one of its faces with a polyurethane polymer layer and having the same air, water, and water vapor imperviousness properties, and folded over itself so as to be welded both on the peripheral edge 1*a* folded over itself of the upper part $1_1$ and on the peripheral edge 1*b* of the lower part $1_2$.

The connecting strip 6 therefore comprises 2 portions folded over each other comprising, from the weld 1*c* with the lower part $1_2$, a portion forming a side rim $6_1$ of the mattress 3 and ending with a zipper device with teeth $6_2$ which when opened allows the mattress to be taken out of the cover 7. The side rim $6_1$ will cover the flanks of the mattress 3. The other portion of the strip extending from the weld 1*c* with the upper part $1_1$ forms a flap $6_3$ which will cover said side rim $6_1$ and the thereby protected zipper device $6_2$.

In some embodiments, said envelope comprises another airtight and watertight opening/closing zipper device, not shown, of the type of the devices used for reversibly sealing bags containing food thereby allowing the envelope to be opened and the intermediate part 2 to be withdrawn in order to clean it regularly.

The invention claimed is:

1. A device for use with a cushion of a mattress, the device comprising an envelope formed by at least two parts having side and end peripheral edges that are connected together such that an inner chamber is provided between the at least two parts, said side and end peripheral edges forming a quadrilateral, the first and second parts being sized to cover substantially all of an upper surface of the cushion of the mattress, said first part comprising a material forming a barrier that is impervious to air and liquid water and that is pervious to water vapor, said second part comprising a material that is pervious to water vapor, said second part comprising an air injection port adjacent one of the side and end peripheral edges of the quadrilateral and a plurality of discrete air discharge ports adjacent each of the other three side and end peripheral edges of the quadrilateral so as to form a U-shaped pattern of discrete air discharge ports made up of three single-row groups of air discharge ports with a central region defined within the U-shaped pattern lacking any air discharge ports, an air supply device forcing air into the air injection port so that the air travels through the inner chamber over the central region and exits downwardly from the inner chamber away from a patient supported atop the first and second parts and toward the cushion, the air exiting only through the plurality of discrete air discharge ports that form the U-shaped pattern, the air injection port and the plurality of air discharge ports the form the U-shaped pattern being the only openings in the second part, wherein the envelope is integrally formed as part of a protective cover that encloses the cushion of the mattress.

2. The device according to claim 1, wherein the water vapor perviousness of said second part is less than that of said first part.

3. The device according to claim 1, wherein the water vapor transfer of said first part is of 750 to 2,000 g of water/$m^2$/24 hrs, and the water vapor transfer of said second part from 300 to 500 g of water/$m^2$/24 hrs.

4. The device according to claim 1, wherein said envelope is inflated by the air supply device with continuously injected pressurized air through said air injection port so as to generate overpressure in said chamber.

5. The device according to claim 1, wherein said second part is substantially airtight between said air injection port and said plurality of air discharge ports, each discharge port of said plurality of air discharge ports being positioned sufficiently far from said air injection port so that substantially the whole volume of said inner chamber is covered by air flowing between said air injection port and said plurality of air discharge ports.

6. The device according to claim 1, wherein a ratio of a sum of cross sections of the plurality of air discharge ports to a cross section of the air injection port is at least 2.

7. The device according to claim 1, wherein said air discharge ports are about 3 mm in diameter and are spaced apart by 10 cm to 20 cm.

8. The device according to claim 1, wherein said second part is of a substantially rectangular shape and the air injection port is in proximity to a middle of one of the side peripheral edges of said second part, said plurality of air discharge ports being positioned in proximity to the other of the side peripheral edges and to both the end peripheral edges.

9. The device according to claim 1, further comprising an intermediate part inside said inner chamber between said first and second parts, said intermediate part being pervious to air and water vapor, said intermediate part comprising a layer of non-woven fiber material.

10. The device according to claim 9, wherein the layer of non-woven fiber material comprises a polyester wadding.

11. The device according to claim 1, wherein the material of said first part comprises a non-watertight and non-airtight porous substrate, said substrate comprises a coating on at least one face with the coating comprising a continuous layer of polymer, impervious to liquid water and air, and having water vapor molecular transfer properties.

12. The device according to claim 11, wherein said substrate comprises a fabric and wherein the polymer is of the polyurethane type.

13. The device according to claim 1, wherein the material of said second part comprises a fabric and a coating on at least one face of the fabric, the coating comprising a polymer layer having water vapor molecular transfer properties.

14. The device according to claim 1, wherein said first and second parts are connected together on their side and end peripheral edges by welding.

15. The device according to claim 1, further comprising an intermediate part inside said inner chamber between said first and second parts, said intermediate part comprising a layer of non-woven fiber substrate held in shape by a holding device.

16. The device according to claim 1, wherein the air supply device injects compressed air through said injection port via a solenoid valve.

17. The device according to claim 16, wherein the air supply device is operable to inflate the cushion of the mattress.

18. The device according to claim 1, further comprising at least one temperature regulation device selected from group consisting of a heating device for heating air and a cooling device for cooling air.

19. A method of using the device of claim 1, the method comprising:

positioning said envelope flat on the cushion of the mattress so that said first part is situated above said second part, and injecting pressurized air with the air supply device into said inner chamber through said air injection port with a pressure and a flow rate sufficient such that said envelope remains inflated and overpressurized in spite of air being discharged from the plurality of air discharge ports.

20. The method according to claim 19, wherein an overpressure of air is established in the inner chamber of the envelope of from 500 to 1,000 Pa.

21. The method according to claim 19, wherein the air flow rate into said inner chamber is at least 20 l/min.

22. The method according to claim 19, further comprising injecting air into the inner chamber of the envelope.

* * * * *